US009008525B2

(12) United States Patent
Kashiwagi

(10) Patent No.: US 9,008,525 B2
(45) Date of Patent: Apr. 14, 2015

(54) IMAGE FORMING APPARATUS AND IMAGE FORMING METHOD

(71) Applicant: Toshiba TEC Kabushiki Kaisha, Tokyo (JP)

(72) Inventor: Ryota Kashiwagi, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 65 days.

(21) Appl. No.: 13/863,761

(22) Filed: Apr. 16, 2013

(65) Prior Publication Data

US 2013/0273464 A1 Oct. 17, 2013

Related U.S. Application Data

(60) Provisional application No. 61/625,046, filed on Apr. 16, 2012.

(51) Int. Cl.

| | |
|---|---|
| ***G03G 15/00*** | (2006.01) |
| ***G03G 13/06*** | (2006.01) |
| ***G03G 15/06*** | (2006.01) |

(52) U.S. Cl.

CPC ..... *G03G 13/06* (2013.01); *G03G 15/06* (2013.01); *G03G 15/5029* (2013.01)

(58) Field of Classification Search

CPC ..... G03G 2215/00721; G03G 2215/00759; G03G 15/5029; G03G 15/6558; G03K 15/021

USPC ..... 399/16, 45

See application file for complete search history.

(56) References Cited

U.S. PATENT DOCUMENTS

| | | | | |
|---|---|---|---|---|
| 6,029,020 | A * | 2/2000 | Blackman et al. | 399/45 |
| 2009/0154970 | A1 * | 6/2009 | Yoshida et al. | 399/341 |
| 2012/0251154 | A1 * | 10/2012 | Qian et al. | 399/82 |

FOREIGN PATENT DOCUMENTS

| | | |
|---|---|---|
| JP | 2010-161745 | 7/2010 |

* cited by examiner

*Primary Examiner* — Gregory H Curran

(74) *Attorney, Agent, or Firm* — Patterson & Sheridan, LLP

(57) ABSTRACT

According to embodiments, an image forming apparatus has a sensor that scans a sheet to detect an identifier on the sheet, which indicates the presence, and orientation, of a form on the sheet, a memory that holds a reference pattern of the identifier, a control section that is configured to compare the identifier detected by the sensor and the reference pattern and determine the orientation of the form, and an image forming unit that form an image on the sheet. The image forming unit is configured to form the image so that the orientation of the image conforms to the orientation of the form.

13 Claims, 5 Drawing Sheets

IMAGE FORMING APPARATUS AND IMAGE FORMING METHOD

CROSS-REFERENCE TO RELATED APPLICATION

This application is based upon and claims the benefit of priority from U.S. Provisional Patent Application No. 61/625,046, filed Apr. 16, 2012; the entire contents of which are incorporated herein by reference.

FIELD

Embodiments described herein relate to an image forming apparatus and an image forming method.

BACKGROUND

For copiers, printers, and other image forming apparatuses, printing of images may be carried out on paper sheets with pre-printed forms on them instead of blank paper sheets. Examples of the forms include well known forms, such as letter forms, invoice forms, postcard forms, and the like.

If an image is to be formed on the preprinted form that has a specific orientation, the paper sheets should be loaded in a paper feeding cassette with the correct orientation of the form. If the sheets are loaded with a wrong orientation, the orientation of the formed image may not conform to the orientation of the form.

In a conventional image forming apparatus, a notice describing the orientation of the form is put on the main body of the image forming apparatus so that the user can load the sheets with a correct orientation in a paper feeding cassette of the image forming apparatus. This is inconvenient for the users.

DETAILED DESCRIPTION

The present disclosure is directed to provide an image forming apparatus and an image forming method that can form the images correctly on the sheet with the form regardless of the orientation of the form of the sheet loaded in the paper feeding cassette.

In general, according to one embodiment, the image forming apparatus and the image forming method will be explained in detail with reference to the drawings.

According to embodiments of the present disclosure, an image forming apparatus has a sensor that scans a sheet to detect an identifier on the sheet, which indicates an orientation of a form on the sheet, a memory that holds a reference pattern of the identifier, a control section that is configured to compare the identifier detected by the sensor and the reference pattern and determine the orientation of the form, and an image forming unit that form an image on the sheet. The image forming unit is configured to form the image so that the orientation of the image conforms to the orientation of the form.

Figure 1:
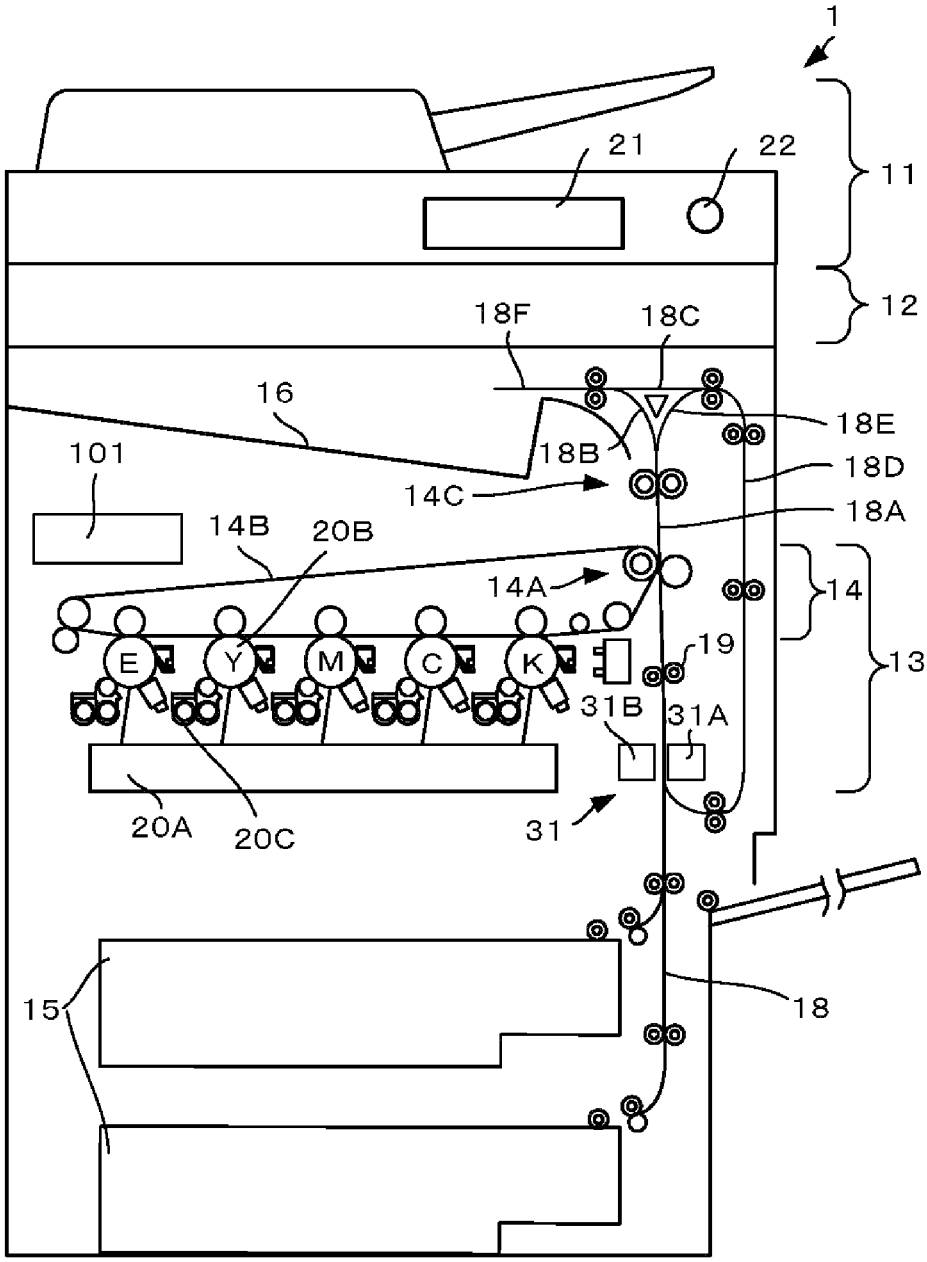
FIG. 1 is a diagram illustrating an example of a configuration of an image forming apparatus.

FIG. 1 is a diagram illustrating the configuration of an image forming apparatus 1. As shown in FIG. 1, the image forming apparatus 1 includes a control section 101, a control panel 21, a start button 22, an automatic document feeding device 11, an image read section 12, an image forming section 13, a transcribing section 14, a paper feeding unit 15, and a conveying mechanism 18.

For example, the control panel 21 is a graphical user interface that displays an input/output for the operation of the image forming apparatus. The user can select a setting of the operation and a cassette of the paper feeding unit 15 from which the sheet is to be fed on the control panel 21.

When the start button 22 is pressed, a signal directing start of image formation is sent to the control section 101.

The automatic document feeding device 11 is arranged in a free opening/closing way at the upper portion of the image forming apparatus 1. The automatic document feeding device 11 feeds the document sheet (hereinafter sheet) one sheet at a time from the paper feeding tray (not numbered in FIG. 1), and the sheet fed from the paper feeding tray is conveyed through the image forming apparatus to the discharge paper tray 16 by a document conveying mechanism (not shown in FIG. 1).

The automatic document feeding device 11 first conveys the sheets by one sheet at a time to a document read section of the image read section 12 by a document conveying mechanism (not shown in FIG. 1). Also, the automatic document feeding device 11 can be opened to manually set the sheet on a document table of the image read section 12.

The image read section 12 includes a carriage having a lamp for illuminating the sheet and a first reflective mirror, a plurality of second reflective mirrors that work together with the carriage, a lens block, and a CCD (Charge Coupled Device) of an image reading sensor.

The carriage is physically fixed in the document reading section 12, or it may alternatively be driven in a reciprocating motion below the document table. The light of the exposure lamp reflected from the sheet is incident on and reflected at the first reflective mirror. The light reflected at the first reflective mirror is reflected at the second reflective mirrors and incident on the lens block. The lens block changes the multiplying factor of the reflected light, and the light passing through the lens block is incident on the CCD. The CCD then converts the incident light to an electric signal, which is then output as an image signal to the image forming unit 13.

The image forming unit 13 may be comprised of any type of system that can form an image, such as an electronic type, an inkjet type, and the like.

The image forming unit 13 of the electronic system, for each of colors (i.e., yellow Y, magenta M, cyan C, black K, and a color of a de-colorable developing agent E), has the following parts: a laser irradiating unit 20A, a photoreceptor drum 20B as an image carrier, a developing agent-supplying unit 20C as a developing agent supplying section that supplies the developing agent. Further the image forming unit 13 has a common transcribing section 14 commonly for the developing agents.

The de-colorable developing agent contains a coloring compound, a developing agent, and a de-coloring agent. An example of the coloring compound is a leuco dye. An example of the developing agent is phenols. Examples of the de-coloring agents are substances that are miscible with the coloring compound that shows a color if heated, and have no affinity with the developing agent.

The de-colorable, i.e., erasable, developing agent shows a color due to the interaction between the coloring compound and the developing agent. Further, if the de-colorable developing agent is heated at or above a de-coloring temperature, the coloring compound and the developing agent stop interacting, resulting in a de-coloration of the color. As used herein, de-coloring, de-colorable, etc. are used to describe a developer which may switch from displaying a color which is visible to the human eye to one which is substantially invisible, and hence "erased", although the developer remains in-situ on the sheet. Color is used to mean indicia such as the RGB color spectra, as well as black and white.

To form an image on a sheet, a laser beam, which is generated based on the image signal, is irradiated from the laser irradiating unit 20A on the photoreceptor drum 20B, so that an electrostatic latent image of an image to be formed on a sheet is formed on the photoreceptor drum 20B. The developing agent supplying unit 20C supplies the developing agent to the photoreceptor drum 20B, so that an image of the developing agent corresponding of the latent image is formed on the photoreceptor drum 20B.

The paper feeding unit 15 feeds sheets one at a time from one of the cassettes to a sheet conveying path of the conveying mechanism 18. The fed sheet is conveyed along the sheet conveying path to the transcribing section 14.

The transcribing section 14 has a transcribing roller 14A and a transcribing belt 14B. As the transcribing belt 14B contacts the photo receptor drums 20B, the images of the developing agents formed on the photoreceptor drums 20B are transcribed onto the transcribing belt 14B. Thus, the transcribing belt 14 carries the image of the developing agent corresponding to the image thereon. Because a certain voltage is applied to the transcribing roller 14A, the image of the developing agent formed on the transcribing belt 14B is transcribed to the conveyed sheet that passes through the transcribing roller 14A.

The image forming apparatus 1 has a heating device 14C disposed downstream, in the sheet conveying direction, with respect to the transcribing roller 14A. In an image forming mode, the heating device 14C heats and presses the developing agent on the sheet so that the image is fixed on the sheet. In an erasing mode, the heating device 14C heats the de-colorable developing agent on the sheet to erase the image and, at the same time, may heat a transcribed non-de-colorable (conventional) developing agent to fix the image formed from the non-de-colorable agent on the sheet.

If the image forming unit 13 is comprised of an inkjet-type system, the image forming unit 13 has an ink supplying device that supplies an ink and an inject head that ejects the supplied ink onto the sheet to form an image thereon.

The inkjet head has piezoelectric elements with different polarities applied thereon, and the piezoelectric elements are arranged in a comb teeth shape. These piezoelectric elements have electrodes arranged thereon. In addition, a cylinder having an inject port for injecting the ink is disposed on the upper end of each piezoelectric element.

A voltage is applied on the electrodes on the piezoelectric elements. As the voltage is applied, the piezoelectric elements are deformed. Due to this deformation, the ink is sucked from a jet port so that the ink is ejected from the jet port towards the sheet.

Depending on the applied voltage level, the applied voltage duty cycle, and the sheet feeding speed, the density of the ink dots formed on the sheet is varied. Thus, the image is formed by the pattern of the ink dots.

The conveying path 18 has a first through a sixth conveying paths 18A-18F. The first conveying path 18A extends from a resist roller 19 that is disposed between the heating device 14C and a sensor 31, as shown in FIG. 1. The second conveying path 18B extends from the heating device 14C to a resist roller 19 that is disposed adjacent to the discharge paper tray 16. The third conveying path 18C extends between the resist roller 19 disposed adjacent to the discharge paper tray 16 (left of the branch point in FIG. 1) and a resist roller 19 disposed at the right side of the branch point in FIG. 1. The fourth conveying path 18D extends from the resist roller 19 that is disposed at the right side of the branch point in FIG. 1 to the resist roller 19 disposed between the heating device 14C and the sensor 31. The fifth conveying path 18E extends between the first conveying path 18A and the fourth conveying path 18D. The sixth conveying path 18F extends from the resist roller 19 disposed adjacent to the discharge paper tray 16 to the discharge paper tray 16.

In the image forming apparatus 1, the sheet passing through the second and the sixth conveying paths can be conveyed to the third conveying path by reversing the rollers conveying the sheet. By passing through the third and the fourth conveying path, the sheet can return to the first conveying path so that an image can be formed on the back surface of the sheet.

Further, in the image forming apparatus 1, the sheet can return to the first conveying path 18A by passing through the fourth conveying path 18D, without changing the surface of the sheet on which an image is to be formed.

The image forming apparatus 1 has a sensor 31, which scans the sheet to detect an identifier indicating the orientation of a form, if present on the sheet. The sensor 31 is arranged upstream, in the sheet conveying direction, with respect to the resist roller 19 disposed between a transcribing roller 14A and the sensor 31, and downstream, in the sheet conveying direction, with respect to the merging point of the first conveying path 18A and the fourth conveying path 18D.

The sensor 31 is suitable for detecting both an identifier formed from a non-de-colorable developing agent and the identifier formed from a de-colorable developing agent.

The sensor 31 has a first sensor 31B that scans a front surface of the sheet, on which an image is to be formed, to detect an identifier on the front surface and a second sensor 31A that scans the other surface (back surface) of the sheet to detect the identifier on the back surface.

The sheet discharged from a paper discharging port (i.e., the end of the sixth conveying path 18F) is stacked in the paper discharge tray 16.

Figure 2:
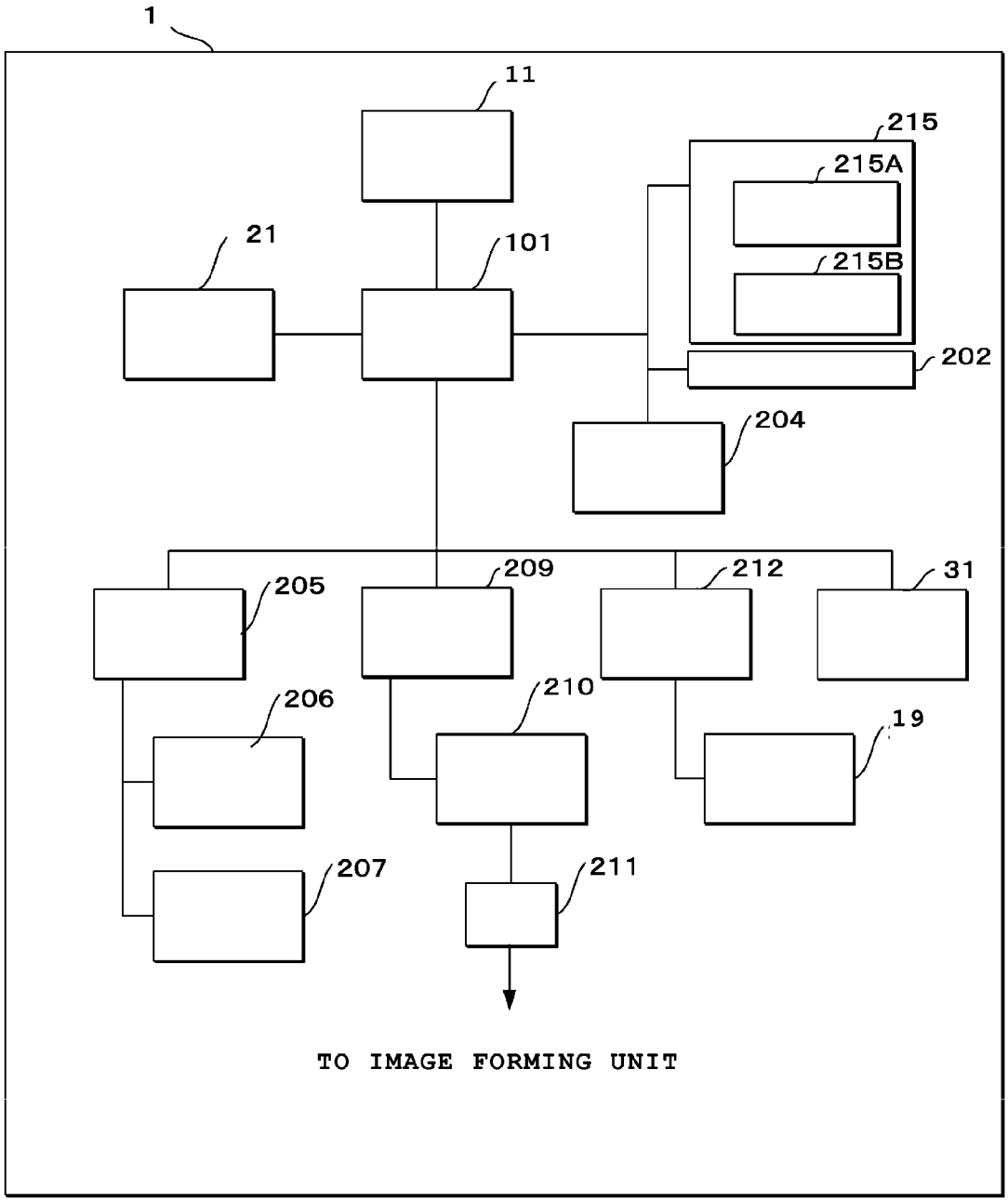
FIG. 2 is a block diagram illustrating an example of the configuration of the image forming apparatus.

FIG. 2 is a block diagram illustrating the configuration of the image forming apparatus 1. As shown in FIG. 2, the image forming apparatus 1 has a main CPU 101 as the control section, a control panel 21 as a display input device, a memory 202, such as ROM, RAM, and the like, an image processing section 204 that carries out an image processing, a memory device 215, such as a hard disk drive and the like, and the sensor 31.

The main CPU 101 is connected to a printing CPU 205, a scanner CPU 209, and a driving controller 212, which are included in the image forming apparatus 1, such that the main CPU 101 controls them.

The printing CPU 205 is connected to a printing engine 206 that carries out the image formation and a processing unit 207 containing a transcribing device, the printing CPU 205 controls them.

The scanner CPU 209 controls a CCD driver 210 that drives a CCD 211. The output of the CCD 211 is sent to the image forming unit.

The driving controller 212 controls the resist roller 19*s* and switches the conveying path through which the sheet passes.

The memory device 215 has a reference pattern file 215A that maintains in a memory the reference patterns of identifiers to be compared with the identifier scanned by the sensor 31, and a form file 215B that maintains in a memory of the forms in relation to the identifiers.

Figure 3:
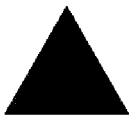
FIG. 3 is a diagram illustrating the first example of a reference pattern of an identifier.

FIG. 3 is a diagram illustrating a first example of a reference pattern of the identifier. As shown in FIG. 3, the identifier may be a symbol, such as a delta or an arrow shape. The delta shown in FIG. 3 indicates that the side facing upward (top apex of the triangle or delta shape) is the upper side of the form, and the side of the sheet on which the reference pattern is formed is the first or front side of the form, if a two sided form corresponds to that identifier. On the form, the identifier is formed in a prescribed position, i.e., a position of the form or sheet on which printing is not intended to be located, such as the upper-right corner of the sheet and the form thereon.

Consequently, the image forming apparatus 1 can determine the front and back surfaces and the orientation of the form on the basis of the scanning result of the sensor 31. Additionally, the identifier may be provided as a de-colorable printing material.

Figure 4:
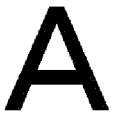
FIG. 4 is a diagram illustrating the second example of the reference pattern of the identifier.

FIG. 4 is a diagram illustrating a second example of the reference pattern of the identifier. As shown in FIG. 4, the identifier may be a letter. The identifier shown in FIG. 4 indicates that the orientation of the letter shows that the upper side of the form is above the letter. The image forming apparatus 1 may determines the orientation of the form by determining the place in a sheet where the identifier is disposed, and/or by the orientation of the identifier.

If the identifier is a letter of an alphabet, the image forming apparatus 1 converts the image on the sheet into a binary code based on the scanning result of the sensor 31, and extracts the letter portion therefrom. Then, the image forming apparatus 1 rotates the extracted letter portion 90° a step, while taking the difference from the reference pattern in pixel units. If it is determined that the difference is lower than a threshold, the image forming apparatus 1 determines the present orientation of the letter as the orientation of the form.

Figure 5:
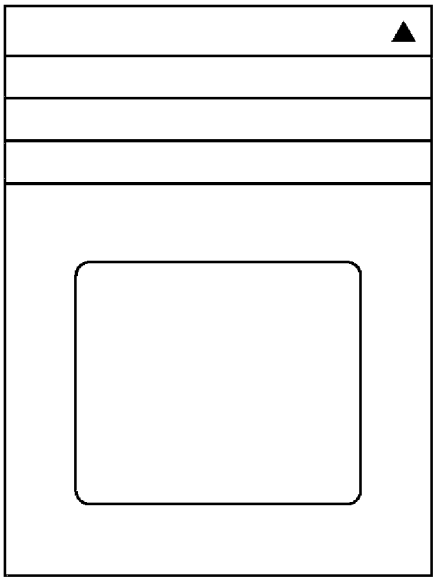
FIG. 5 is a diagram illustrating a first example of the form having an identifier.

FIG. 5 is a diagram illustrating an example of the form having the symbol type, i.e., non-alphabetic, identifier. As shown in FIG. 5, the identifier was previously formed on the upper-right corner of the image-forming surface of the sheet.

The developing agent for forming the identifier is preferably the de-colorable developing agent, because the identifier need not remain on the form after the image is formed on the sheet.

Figure 6:
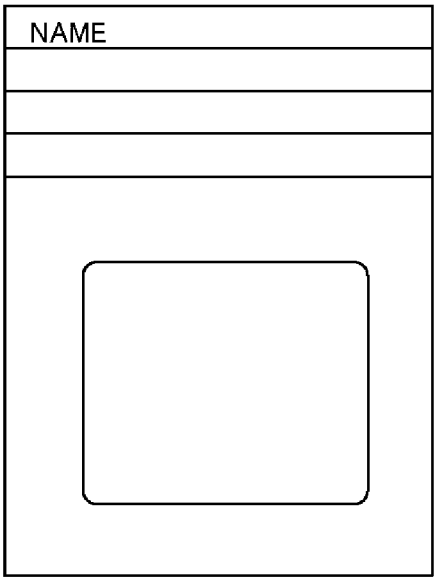
FIG. 6 is a diagram illustrating a second example of the form having an identifier.

FIG. 6 is a diagram illustrating an example of the form having an identifier as a letter. As shown in FIG. 6, the identifier may be a letter contained in a word that has been formed beforehand on the sheet. In the example shown in FIG. 6, "A" in "NAME" is used for an identifier. Where the alphabetic character, or letter, is apart of the form, it need not be provided with de-colorable developer.

If the entire form, rather than the identifier, is registered as a reference form in the form file 215B, the image forming apparatus 1 scans the entire form by the sensor 31, and, by comparing the scanned form with the reference form while the scanned image of the form is rotated. Through this process, it is possible to detect the orientation of the form.

Figure 7:
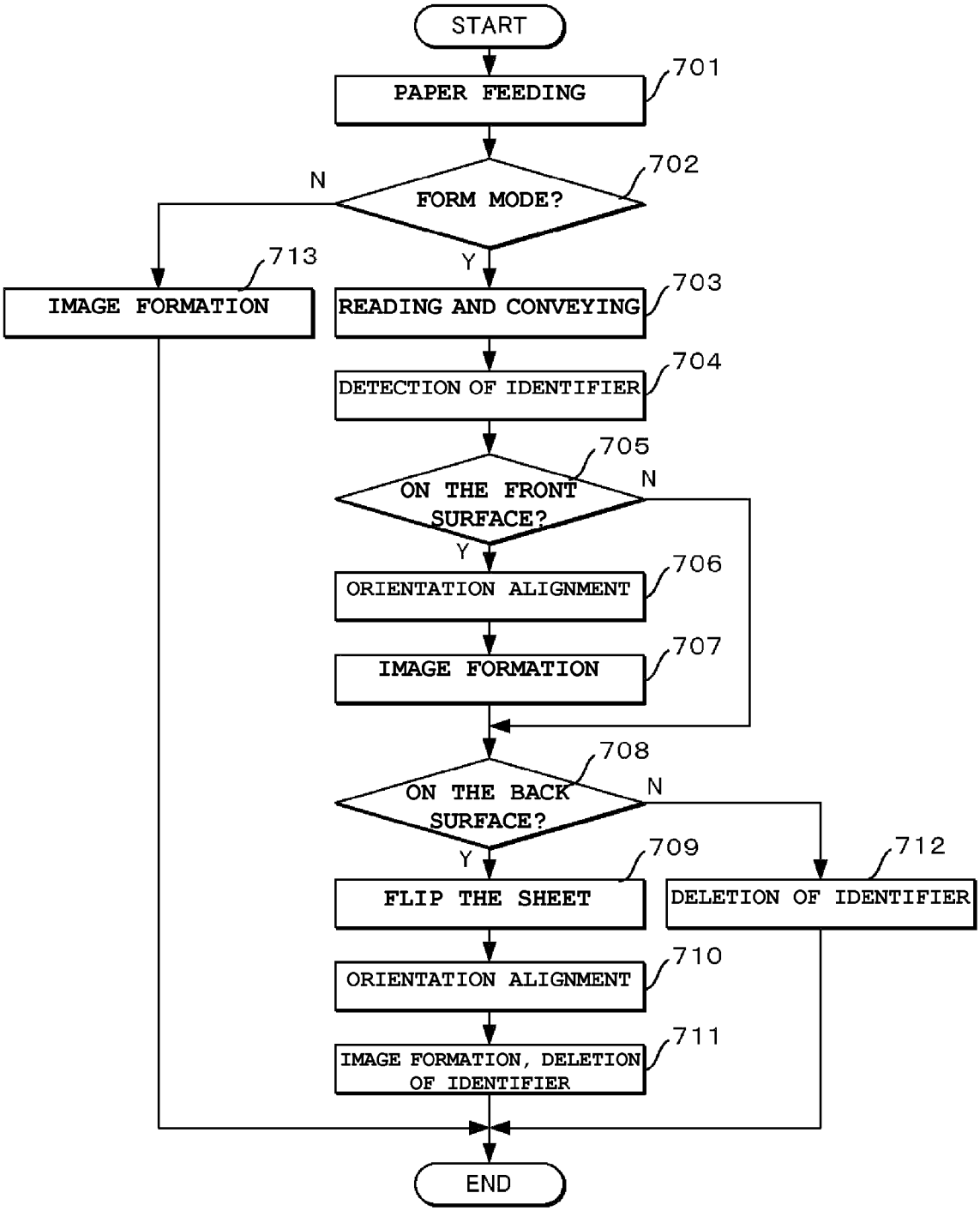
FIG. 7 is a flow chart diagram illustrating a first example of the operation of the image forming apparatus.

FIG. 7 is a flow chart illustrating a first example of the operation of the image forming apparatus 1. As shown in FIG. 7, in step 701, the image forming apparatus starts feeding a sheet to form an image on the sheet.

In step 702, the image forming apparatus 1 determines whether the user has selected a form mode, i.e., a mode for forming the image on a sheet with a preprinted, or a later to be printed, form. If the form mode has been selected, the operation process goes to step 703. If the form mode is not selected, it goes to step 713.

In step 703, the image forming apparatus 1 carries out read-and-conveying operation in which the sensor 31 scans the sheet to detect the identifier. In this read-and-conveying operation, the image forming apparatus 1 conveys the sheet in the following order: first conveying path 18A→>fifth conveying path 18E→fourth conveying path 18D→first conveying path 18A.

As the sheet is conveyed through the conveying paths in this order, the sensor 31 can scan the whole area of a sheet to find the identifier before forming an image on the sheet even if the sheet is a long sheet.

In step 704, based on the scanning result of the sensor 31, the image forming apparatus 1 recognizes whether the identifier is formed and if so, where on the sheet the identifier is formed. Further, based on the location and/or orientation of the identifier, the image forming apparatus 1 recognizes the orientation of the form on the sheet.

In step 705, the image forming apparatus 1 determines whether the identifier is formed on the front surface, i.e., the image forming surface. If the image forming apparatus 1 determines that the identifier is formed on the front surface, the operation process goes to step 706. If the image forming apparatus 1 determines that the identifier is not formed on the front surface, it goes to step 708.

In step 706, the image forming apparatus 1 carries out an orientation alignment treatment, in which the image forming apparatus corrects orientation of the image to be formed on the sheet to match the orientation of the form. For example, suppose the image forming apparatus 1 recognized that the sheet is rotated by 90° to the right, the image forming apparatus 1 corrects the orientation of the image to be formed, by correcting the orientation of the stored image fetched from the memory 202 for printing is rotated 90° to the right.

In step 707, the image forming apparatus 1 forms the orientation-corrected image on the sheet.

In step 708, the image forming apparatus 1 determines whether the identifier is formed on the back surface of the sheet, i.e., the surface on which the image has not yet been formed on the sheet. If the image forming apparatus 1 determines that an identifier is formed on the back surface of the sheet, the operation process goes to step 709. On the other hand, if the image forming apparatus 1 determines that no identifier is formed on the back surface of the sheet, the process goes to step 712.

In step 709, the image forming apparatus 1 flips the surface of the sheet on which the image is formed. In order to flip the surface of the sheet, the image forming apparatus 1 conveys the sheet in the following order: first conveying path 18A→second conveying path 18B, sixth conveying path 18F→third conveying path 18C→fourth conveying path 18D first conveying path 18A.

In step 710, the image forming apparatus 1 carries out the orientation alignment of the image to the sheet/form orientation.

In step 711, the image forming apparatus 1 carries out an image formation treatment. At the same time (simultaneously), the image forming apparatus 1 turns on the heating device 14C at a temperature over the de-coloring temperature, so that the identifier formed of a de-colorable developing agent will be erased.

In step 712, if the identifier is on the front surface, the image forming apparatus 1 turn on the heating device 14C at a temperature over the de-coloring temperature, so that the identifier formed of the de-colorable developing agent will be erased.

In step 713, the image forming apparatus 1 carries out the conventional image forming treatment.

Figure 8:
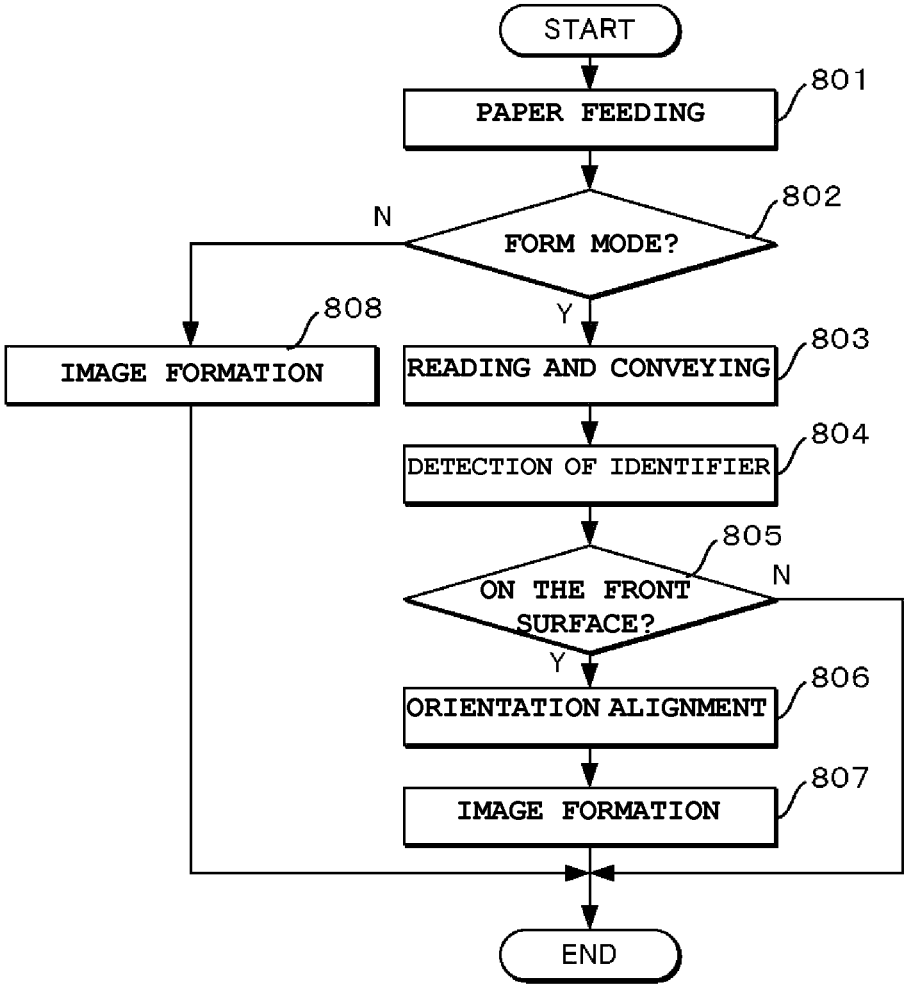
FIG. 8 is a flow chart diagram illustrating a second example of the operation of the image forming apparatus.

FIG. 8 is a flow chart illustrating a second example of the first operation of the image forming apparatus 1. As shown in FIG. 8, in step 801, the image forming apparatus 1 starts feeding a sheet on which an image is to be formed.

In step 802, the image forming apparatus 1 determines whether the form mode, i.e., the mode for forming the image on the form, has been selected by the user. If the form mode is selected, the operation process goes to step 803, and, if the form mode is not selected, it goes to step 808.

In step 803, the image forming apparatus 1 carries out a read-and-conveying operation in which the sensor 31 scans the sheet to detect the identifier. The image forming apparatus 1 carries out this read-and-conveying operation by conveying the sheet through the conveying path 18 in the following order: first conveying path 18A→fifth conveying path 18E→fourth conveying path 18D→first conveying path 18A.

By this conveying operation, even a long sheet loaded in the paper feeding cassette the orientation of which is upside down can be recognized by the image forming apparatus 1.

In step 804, based on the scanning result of the sensor 31, the image forming apparatus 1 recognizes whether the identifier is formed and if so, where on the sheet the identifier is formed. Further, based on the location and/or orientation of the identifier, the image forming apparatus 1 recognizes the orientation of the form on the sheet.

In step 805, the image forming apparatus 1 determines whether the identifier is on the front surface of the sheet. If the image forming apparatus 1 determines that the identifier is on the front surface, the operation process 1 goes to step 806. If the image forming apparatus determines that the identifier is not formed on the front surface of the sheet, the operation process ends.

In step 806, the image forming apparatus 1 corrects orientation of the image to be formed on the sheet to match the orientation of the form. For example, if the image forming apparatus recognized that the sheet is rotated by 90° to the right, the image forming apparatus 1 corrects the orientation of the image to be formed, by correcting the orientation of the image stored in memory 202 and fetched for printing is rotated 90° to the right.

In step 807, the image forming apparatus 1 forms the orientation-corrected image on the sheet.

In step 808, the image forming apparatus 1 carries out the conventional image forming treatment.

According to the second example of the operation of the image forming apparatus 1, it is preferred to adopt an inkjet printer that forms images for only one surface of the sheet as the image forming apparatus. For example, even if the orientation in loading a sheet in the paper feeding cassette is incorrect, it is still possible to form the image with a correct orientation by the above-mentioned image forming apparatus 1. In this case, where a postcard is used as the sheet, the identifier can be positioned in the region of the postcard to which a stamp will be affixed.

As explained above, the image forming unit is configured to form the image so that the orientation of the image conforms to the orientation of the form.

Due to this configuration, the user can load the sheets in the paper feeding cassette without paying attention to the orientation of the form of the sheets. Regardless of the orientation of the form on the sheets, the image can always be formed in a correct orientation with respect to the form.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a sensor that scans a sheet to detect an identifier on the sheet, which indicates an orientation of a form on the sheet;

a memory that stores a reference pattern of the identifier;

a control section configured to compare the identifier detected by the sensor and the reference pattern and thereby determine the orientation of the form;

an image forming unit that forms an image on the sheet; and a heating device configured to heat the sheet, wherein the image forming unit is configured to form the image so that the orientation of the image conforms to the orientation of the form, and the heating unit is configured to heat the identifier to de-color the identifier if the sensor detects that the identifier is on the sheet.

2. The image forming apparatus according to claim 1, wherein the image forming unit is configured to form the image with a de-colorable developing agent.

3. The image forming apparatus according to claim 1, wherein the heating unit is configured to heat both sides of the sheet so that identifiers on both sides of the sheet can be de-colored.

4. The image forming apparatus according to claim 1, wherein the image forming unit is configured to form the image with a non-de-colorable developing agent, and the heating unit is configured to heat both the identifier and the image formed by the image forming unit simultaneously.

5. The image forming apparatus according to claim 1, wherein the memory stores a letter as the reference pattern.

6. The image forming apparatus according to claim 1, wherein the memory stores the form as the reference pattern.

7. The image forming apparatus according to claim 1, wherein the sensor is disposed upstream, in a sheet conveying direction, with respect to the image forming unit.

8. The image forming apparatus according to claim 1, further comprising:

a sheet conveying mechanism configured to return the sheet that has passed through the image forming unit to the image forming unit without changing the side of the sheet presented to the image forming unit.

9. The image forming apparatus according to claim 1, further comprising:

a sheet conveying mechanism configured to invert the surface of the sheet on which the image is to be formed, wherein the sensor is configured to scan both sides of the sheet to detect the identifier, the control section is configured to control the sheet conveying mechanism so that the sheet, on which the image is to be formed, is inverted if the sensor detects the identifier on the surface of the sheet on which the image is not formed at the image forming unit.

10. An image forming method, comprising:

detecting an identifier on a sheet, which indicates an orientation of a form on the sheet;

determining the orientation of the form by comparing the detected identifier with a reference pattern of the identifier;

forming an image on the sheet so that the orientation of the image conforms to the orientation of the form; and heating the sheet to de-color the identifier.

11. The method according to claim 10, wherein the image is formed using a de-colorable developing agent.

12. The method according to claim 10, wherein both sides of the sheet are heated so that identifiers on both sides of the sheet can be de-colored.

13. The method according to claim 10, wherein the image is formed with a non-de-colorable developing agent, and both the identifier and the image formed by the image forming unit are heated simultaneously.

* * * * *